US005934275A

United States Patent [19]

Gazzara

[11] Patent Number: 5,934,275

[45] **Date of Patent: *Aug. 10, 1999**

[54] MASK WITH ELASTIC WEBBING

[75] Inventor: Peter J. Gazzara, Reading, Mass.

[73] Assignee: Splash Shield, LP, Woburn, Mass.

[ * ] Notice: This patent is subject to a terminal disclaimer.

[21] Appl. No.: 08/641,333

[22] Filed: Apr. 30, 1996

Related U.S. Application Data

[63] Continuation-in-part of application No. 08/529,700, Sep. 15, 1995, Pat. No. 5,803,077.

[51] Int. Cl.[6] ..... A62B 7/10

[52] U.S. Cl. ..... 128/205.27; 128/206.13; 128/207.11

[58] Field of Search ..... 128/205.27, 205.28, 128/205.29, 206.13, 206.19, 207.11; 2/206

[56] References Cited

U.S. PATENT DOCUMENTS

| | | | |
|---|---|---|---|
| 1,035,217 | 8/1912 | McQuary, Jr. | 2/206 |
| 1,292,095 | 1/1919 | Schwartz | 128/206.13 |
| 1,324,747 | 12/1919 | Runyan | 128/207.11 |
| 2,248,477 | 7/1941 | Lombard | 128/207.11 |
| 3,013,556 | 12/1961 | Galleher, Jr. | 128/207.11 |
| 3,603,315 | 9/1971 | Becker, III . | |
| 3,802,429 | 4/1974 | Bird . | |
| 3,834,384 | 9/1974 | Raines . | |
| 3,971,369 | 7/1976 | Aspelin et al. . | |
| 4,035,875 | 7/1977 | Kobelt | 24/203 R |
| 4,355,637 | 10/1982 | Dyer . | |
| 4,720,415 | 1/1988 | Vander Wielen et al. . | |
| 4,802,473 | 2/1989 | Hubbard et al. . | |
| 4,827,923 | 5/1989 | Bishop et al. | 128/207.11 |
| 5,035,006 | 7/1991 | Hetz et al. | 128/207.11 |
| 5,226,992 | 7/1993 | Morman . | |
| 5,265,280 | 11/1993 | Walsh | 2/206 |
| 5,316,837 | 5/1994 | Cohen . | |
| 5,343,561 | 9/1994 | Adamo | 2/206 |
| 5,366,793 | 11/1994 | Fitts, Jr. et al. | 428/198 |
| 5,385,775 | 1/1995 | Wright . | |
| 5,400,780 | 3/1995 | Nishino | 128/206.19 |
| 5,492,753 | 2/1996 | Levy et al. | 428/219 |

FOREIGN PATENT DOCUMENTS

WO 97/40890 11/1997 WIPO .

*Primary Examiner*—Aaron J. Lewis
*Attorney, Agent, or Firm*—Choate, Hall & Stewart

[57] ABSTRACT

A mask and a method for producing a mask that includes a cover material for covering a portion of a face of a wearer and a hypoallergenic, anisotropic elastic material for securing the cover material to the face of the wearer.

35 Claims, 6 Drawing Sheets

MASK WITH ELASTIC WEBBING

BACKGROUND OF THE INVENTION

This application is a continuation-in-part application of application U.S. Ser. No. 08/529,700, filed on Sep. 15, 1995 now U.S. Pat. No. 5,803,077.

This invention relates to masks.

The quality of a mask depends on several criteria. Breathability, comfort and donning ease are important factors for all types of masks. The materials comprising a mask must also be considered. For example, materials that commonly cause allergic reactions should be avoided.

For masks utilized to prevent the spread of contaminants to and from a wearer, additional factors must be evaluated, such as filtration effectiveness. In certain environments, such as the operating room, the health hazards of contamination require that masks be disposed of after only one usage. The manufacturing costs of such masks must therefore be low, so that large quantities can be sold at an affordable price to consumers.

Also, a high quality mask must attach securely, yet comfortably, to a wearer's face. In most instances, a loose, unreliably-fitting mask is merely a nuisance. In environments such as the operating room, however, serious harm may result if a mask loosens or falls off. Thus, high standards must be met with regard to the manner in which a mask fits. Masks for filtering harmful contaminants must not only attach securely, but must also conform to a wearer's face, so as to prevent contaminants from entering and exiting through the sides of the masks.

The manner in which a mask fits and conforms to a wearer's face, as well as the degree of comfort a mask provides, depends largely on the type of straps or ties attached to the mask. The materials typically employed to fasten masks include elastic headbands, elastic ear loops, cloth ties and adhesive strips. While some of these materials are better than others at securing masks, none of them have the combined characteristics necessary to create a secure-fitting, comfortable, hypoallergenic, inexpensive mask that is easy to don. The lack thereof is particularly notable with regard to surgical masks.

The traditional type of surgical mask has cloth ties attached to both sides of the mask that tie together behind a wearer's head. This version of mask is difficult to don, requiring extra time and often the assistance of another person. Since medical personnel frequently encounter life-threatening situations where speed is of the utmost importance, time lost to securing masks must be avoided. Furthermore, surgical masks that tie tend to become loose, thereby posing a risk of contamination to the surgical instruments and to the patient. To prevent such masks from loosening or, worse yet, falling off entirely, medical personnel tend to tie the straps together so tightly that the masks are uncomfortable.

Although masks with adhesive strips and elastic bands can be easily and quickly donned, both of these types of masks are uncomfortable. Adhesive is painful to remove from the skin and elastic bands tend to consist of thin, tight straps that press into the skin. During long periods of wear, the pressure from elastic straps secured around the head or the ears tends to cause headaches and skin irritation from rubbing, particularly behind the ears where the skin is soft. Lastly, the pulling force exerted by elastic tends to cause masks to pucker along the sides of a wearer's face, leaving openings through which contaminants can spread.

In addition to causing discomfort, elastic tends to cause allergic reactions because it often includes latex, a hyper-allergenic material that has long been the source of complaints by the medical community. Lastly, the high cost of manufacturing elastic makes it a somewhat undesirable constituent for the production of affordable, and therefore disposable, masks.

A need has thus arisen for a mask that can be easily and quickly donned, yet securely fastened to a wearer's face with a hypoallergenic, comfortable material that can be produced at a low cost.

SUMMARY OF THE INVENTION

The present invention disclosed herein comprises a mask and a method for producing a mask. The mask includes a cover material designed to cover a portion of a wearer's face. In order to attach the cover material to a wearer's face, the mask further includes a hypoallergenic, anisotropic elastic material, the use of which results in a substantially superior mask that fits securely, yet comfortably, is easy to don, and is also inexpensive to produce.

An anisotropic elastic may be defined as an elastic that stretches substantially in only one direction. Prior art elastics for securing masks tend to be isotropic, which means that these elastics stretch substantially in more than one direction, such that the different stretching directions are not independent from each other.

Several advantages arise from using an anisotropic elastic over an isotropic elastic for securing a mask to a wearer's face. First of all, anisotropic elastics have a high resistance to elongation, which is an essential property for creating a firm, long-lasting attachment. Unlike anisotropic elastics, isotropic elastics, when stretched, tend to compensate by thinning out, i.e., contracting in the direction perpendicular to stretching, thereby resulting in a diminished resistance to elongation. Because anisotropic elastics stretch substantially in only one direction, such overcompensation in the perpendicular direction does not occur. Furthermore, with this higher resistance to elongation, anisotropic elastics do not permanently stretch out of shape as quickly as do isotropic elastics. Thus, in appropriate settings, masks secured by anisotropic elastics may be re-used on numerous occasions.

Masks secured by anisotropic elastics are excellent at filtering contaminants. Because stretching occurs substantially in only one direction—in this case, away from the wearer's face—a greater pulling force may be exerted perpendicular to the sides of the cover material. Rather than puckering, the cover material may therefore be pulled smoothly and evenly away from a wearer's face. In addition, by maintaining their widths in the direction perpendicular to stretching, anisotropic elastics are able to exert a pulling force over a larger area of the cover material than is achievable by isotropic elastics. Thus, the perimeter of the cover material can be properly conformed to the wearer's face, rather than sagging or puckering. Lastly, since anisotropic elastics do not thin out after prolonged use, the numerous advantages conferred on masks secured by anisotropic elastics are not lost after long periods of wear.

Anisotropic elastics may be made from hypoallergenic materials, to produce comfortable, soft elastics that do not press into a wearer's skin. Because anisotropic elastics have a high resistance to elongation, anisotropic elastics used to secure masks need not be pulled so tightly that pressure around the head or ears results. In addition, as opposed to masks with ties, masks secured by anisotropic elastics may be quickly and easily donned without assistance—whether this involves complete removal or conveniently hanging the masks around the neck for later use.

Lastly, anisotropic elastics may be produced at a low cost, which allows masks incorporating anisotropic elastics to be produced at a low cost as well. Thus, large quantities of such masks may be sold at an affordable price, making them ideal as disposable masks. Furthermore, for masks requiring extraordinary strength and stability, large amounts of anisotropic elastics may be inexpensively incorporated into each unit mask.

The present patent application specifically describes and illustrates several embodiments in which a material covering a wearer's nose and mouth is secured to the wearer's face by anisotropic elastic bands or loops attached to the right and left sides of the mask so as to encircle the wearer's head or ears. The embodiments of the cover material have pleats formed into the cover material, so that the cover material expands in the center when worn. One embodiment further includes reinforcing side seams around the perimeter of the cover material and a semi-rigid horizontal member, located at the top of the cover material, for molding against the wearer's nose and facial features, thereby forming a seal to prevent the spread of contaminants.

In addition, the present patent application specifically describes and illustrates several embodiments of anisotropic elastic materials and methods utilized to form anisotropic elastic materials. These embodiments include a single anisotropic elastic layer and anisotropic composite elastics. The anisotropic composite elastics may be formed from joining the following layers: an anisotropic elastic to an isotropic elastic, an anisotropic elastic to a non-elastic, an anisotropic or isotropic elastic to a non-elastic substantially crystalline polymer layer, and a first anisotropic elastic to a second anisotropic elastic.

Although several embodiments of the mask and methods for making the mask are described, this invention is not limited to any particular embodiment. For example, this invention is not limited to a particular method of making an anisotropic elastic material comprising a single layer, nor is it limited to a particular method of making an anisotropic composite material. This invention is also not limited to a particular number of material layers comprising an anisotropic composite material. Furthermore, this invention is not limited to a particular design or shape of the anisotropic elastic material utilized to secure the mask to a wearer's face. In addition, this invention is not limited to attachments of the anisotropic elastic material to particular locations of the cover material, a particular method of attaching the anisotropic elastic material to the cover material, a particular fabric comprising the cover material, or a particular design of the cover material.

DETAILED DESCRIPTION OF THE INVENTION

Figure 1:
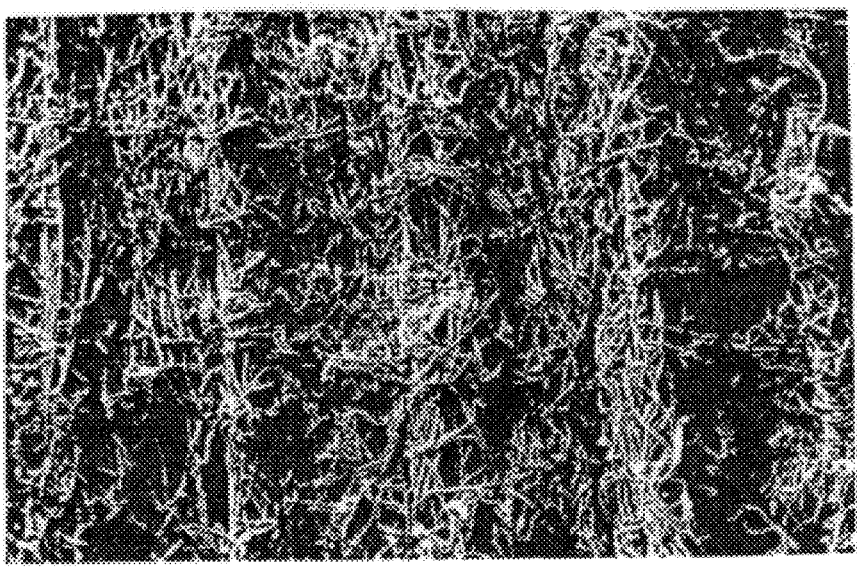
FIG. 1 PRIOR ART
FIG. 1 is a photomicrograph of an exemplary anisotropic elastic material.

The present invention comprises a mask having a cover material that attaches to a wearer's face by a hypoallergenic, anisotropic elastic material and a method for making such a mask.

Anisotropic Elastic Material

First Embodiment

In a first embodiment, the anisotropic elastic material portion of the mask comprises at least one layer of elastomeric filaments and at least one layer of elastomeric fibers. The fibers are dispersed among the elastomeric filaments with substantially uniform density and are oriented in all directions. The filaments are arranged in substantially parallel rows with substantially uniform density. Due to the length and orientation of the filaments, the anisotropic elastic is able to stretch substantially only in the direction parallel to the filaments. The extent to which the elastic is anisotropic versus isotropic may be varied, however, by adjusting such parameters as the ratio of fiber lengths to filament lengths and the ratio of fiber concentration to filament concentration.

The elastomeric fibers and elastomeric filaments may be made from any material that may be manufactured into such fibers and filaments. Generally, any suitable elastomeric fiber-forming resins or blends containing the same may be utilized for the elastomeric fibers and any suitable elastomeric filament-forming resins or blends containing the same may be utilized for the elastomeric filaments. The fibers and filaments may be formed from the same or different elastomeric resin. For example, the fibers and filaments may comprise one or more elastomeric polymers, such as polyesters, polyurethanes, polyamides, copolymers of ethylene and at least one vinyl monomer, and A—B—A' block copolymers wherein A and A' are the same or different polymer, and wherein B is an elastomeric polymer block.

The elastomeric fibers may also comprise a mixture of elastomeric polymers and one or more other materials, for example, wood pulp, particulates, superabsorbent materials and nonelastic fibers, such as polyester fibers, polyamide fibers, glass fibers, polyolefin fibers, cellulosic-derived fibers, multi-component fibers, natural fibers and absorbent fibers. Examples of particulate materials include activated charcoal, clays, starches and metal oxides.

The elastomeric filaments and the elastomeric fibers of the anisotropic elastic material may be manufactured by a variety of extrusion techniques. The anisotropic elastic material is formed by depositing the extruded fibers and the extruded filaments onto a surface so that the filaments form substantially parallel rows on the surface and the fibers are dispersed among the filaments in all orientations, at a substantially uniform density. This method can be carried out by either depositing the extruded filaments first and then depositing the extruded fibers onto the filaments or vice versa. One method of forming a continuous sheet of the anisotropic elastic material comprises depositing the extruded filaments and fibers onto a moving surface by stationary equipment.

The elastomeric fibers and the elastomeric filaments may bond wholly autogenously, partially autogenously, or non-autogenously. For example, where bonding occurs partially autogenously or non-autogenously, bonding may be improved or accomplished through the addition of tackifying resins to the filament-forming and/or fiber-forming compositions, prior to extrusion. In addition to heat that may be applied during certain extrusion processes, heat, as well as pressure, may be applied to the elastomeric fibers and filaments after deposition to improve or to accomplish bonding. Other methods that may be utilized to improve or accomplish bonding include ultrasonic welding, powder bonding, pattern embossing, solvent bonding, hydraulic entangling, and needle punching.

One example of an anisotropic elastic material formed by an extrusion process is disclosed in U.S. Pat. No. 5,385,775, from which FIGS. 1 and 2 were obtained and whose teachings are herein incorporated by reference. The disclosed example describes a meltblowing die arrangement with two separate dies—one for forming the filaments, the other for forming the fibers. The dies extend across a foraminous collecting surface in a direction substantially transverse to the direction of movement of the collecting surface. The extruded threads are deposited onto the collecting surface, with the filament-forming die positioned first so that the filaments form prior to the deposition of the elastomeric fibers onto them. Because the dies deposit the extruded threads in a molten or semi-molten state, the fibers blend with the filaments and solidify, bonding at least partially autogenously. The addition of a compatible tackifying resin to the extrudable elastomeric fiber composition, with examples of tackifying resins, is also discussed. A tackifying resin may, alternatively, be added to the extrudable filament-forming resin.

FIG. 1 is a 24.9 X photomicrograph of an exemplary anisotropic elastic material. FIG. 1 shows substantially parallel rows of continuous filaments covered by a layer of meltblown fibers. The substantially parallel rows of filaments run from the top of the photo to the bottom of the photo.

Figure 2:
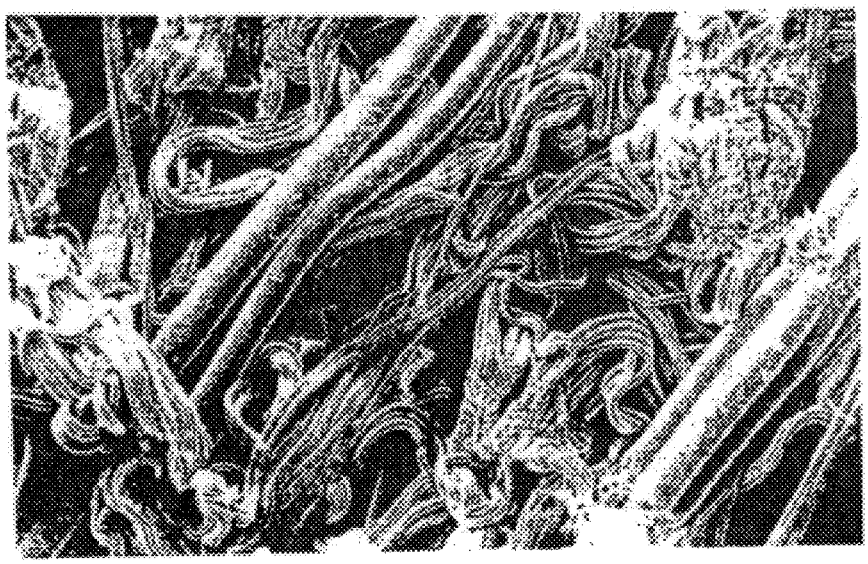
FIG. 2 PRIOR ART
FIG. 2 is a photomicrograph of an exemplary anisotropic elastic material, which shows a flip-side of the material shown in FIG. 1.

FIG. 2 is a 24.9 X photomicrograph which shows a flip-side of the material shown in FIG. 1. The substantially parallel rows of continuous filaments rest upon a layer of meltblown fibers.

Second Embodiment

In a second embodiment of the invention, an anisotropic elastic material, such as the material of the first embodiment, is joined to an isotropic elastic material in at least two locations to form an anisotropic composite elastic material. The isotropic elastic layer is thereby limited to stretching in the direction imposed by the anisotropic layer.

The two layers may be joined by any suitable means, as long as the method of joining does not destroy the anisotropic nature of the anisotropic layer. Methods of joining include the application of heat and/or pressure to the portions of the layers to be joined. For example, joining by the application of heat may be accomplished by overlaying the layers and heating the desired portions of the layers to at least the softening temperature of the layer with the lowest softening temperature to form a reasonably strong and permanent bond between the re-solidified softened portions of the layers.

The temperature to which the layers, or at least the bond sites thereof, are heated for bonding will depend not only on the temperature of the heat source but also on the residence time of the layers on the heated surfaces, the compositions of the layers, the basis weights of the layers and their specific heats and thermal conductivities. For a given combination of materials, the conditions necessary to achieve satisfactory bonding in thermal bonding processes can be readily determined by one skilled in the art.

An exemplary process for joining two or more layers is disclosed in U.S. Pat. No. 5,385,775, to which reference was previously made. Other methods of joining the two layers include ultrasonic welding, powder bonding, pattern embossing, thermal pin embossing, solvent bonding, gluing, needle punching, hydraulic entangling, and the use of tension wind-up techniques, adhesives, pressure-sensitive adhesives, high energy electron beams, and/or lasers.

The anisotropic layer may be comprised of any of a variety of materials, including those discussed with regard to the first embodiment. The isotropic layer may be comprised of any of a variety of materials as well, as long as the materials enable the isotropic layer to be joined to the anisotropic layer in the described manner, to form an anisotropic composite elastic. For example, the isotropic layer may comprise a single type of fiber or a mixture of fibers, including, for example, spunbonded fibers, meltblown fibers or a bonded carded web of fibers. The isotropic layer may also comprise a mixture of fibers and one or more other materials, such as particulates or wood pulp.

The isotropic layer may be manufactured by any process that produces an isotropic elastic that is capable of being joined to the anisotropic layer to form an anisotropic composite elastic. Examples of such processes include meltblowing, spunbonding or film extrusion processes, but numerous methods for manufacturing a suitable isotropic layer exist, as one skilled in the art will appreciate.

Third Embodiment

In a third embodiment of the invention, an anisotropic composite elastic is formed by joining an anisotropic elastic material, such as the material of the first embodiment, to a non-elastic material at spaced-apart locations while the anisotropic layer is maintained in a desired stretched condition, so that, upon relaxation of the anisotropic elastic layer, the non-elastic layer forms gathers, pleats or loops between the spaced-apart locations. The extent to which the resulting anisotropic composite elastic is capable of stretching may be varied by adjusting the tensioning force applied on the anisotropic layer as it is joined to the non-elastic layer.

The non-elastic layer has a fixed length, which may be defined as its planar length—that is, the length achieved by pulling the non-elastic smoothly from end-to-end, so that no gathers, pleats or loops exist and the entire surface of the non-elastic lies in the same plane. Because the non-elastic layer has a fixed length, the maximum length achievable upon elongation of the anisotropic composite elastic is limited to the fixed length of the non-elastic layer.

Joining the two layers may be accomplished by any suitable means, as long as the method of joining does not destroy the anisotropic nature of the anisotropic layer and the method of joining allows the non-elastic layer to form gathers, pleats or loops between the spaced-apart locations. Appropriate joining methods include those methods discussed with regard to the second embodiment.

The anisotropic layer may be comprised of any of a variety of materials, including those discussed with regard to the first embodiment. The non-elastic layer may be comprised of any of a variety of materials as well, as long as the materials enable the non-elastic layer to be joined in the described manner to the anisotropic layer, to form an anisotropic composite elastic.

Fourth Embodiment

In a fourth embodiment of the invention, an anisotropic composite elastic is formed by joining an elastic material, such as the elastic material of the first embodiment, to a substantially crystalline polymer layer to which a desirable degree of elasticity is imparted through the application of heat to a temperature below the melting point of the polymer layer.

The heat treating process enables the crystals of a normally non-elastic polymer to be annealed into modified structures, so that, if simultaneously cooled and held in a stretched configuration, the polymer becomes capable of stretching and recovering. Typically, the temperature to which a polymer must be heated, so that the crystals are capable of being structurally modified, is just below the melting point of the crystals. The ideal temperature, referred to herein as the "transition temperature", is characteristic of a substantially crystalline polymer and may be determined by Differential Scanning Calorimetry techniques.

An anisotropic composite elastic is formed according to this embodiment of the invention by heating a non-elastic, substantially crystalline polymer layer to its transition temperature and then simultaneously cooling the polymer layer while stretching it, so that the polymer layer gains a desirable degree of elasticity in the direction of stretching. The extent to which the polymer layer becomes capable of stretching may be varied by adjusting such parameters as the tensioning force with which the polymer layer is stretched, the length of time the layer is held in the stretched configuration, and the rate of cooling after reaching the transition temperature. In addition, the polymer layer may be imparted anisotropic or isotropic elasticity. The former is achieved by applying a tensioning force in one direction only; the latter, by applying a tensioning force in two directions.

Upon completion of the heat treating process, an anisotropic composite elastic may be formed by joining the polymer layer and the elastic layer in at least two locations while both layers are in a relaxed state, wherein the one-directional stretch is achieved by restricting one or both layers to anisotropic materials. The resulting composite is therefore limited to stretching in the direction parallel to the stretching direction of the layer that is anisotropic. In addition, the maximum length achievable upon elongation of the resulting anisotropic composite elastic is limited by the layer capable of stretching the least.

Joining the two layers to produce an anisotropic composite elastic may be carried out by any suitable means, as long as the method of joining does not destroy or alter the anisotropic elasticity of either the elastic or the polymer layer. For example, if joining is accomplished by applying heat to the layers, the temperature to which the layers are raised must remain below the transition temperature of the crystals. In addition to heat bonding, additional methods that are appropriate include those methods discussed with regard to the above embodiments.

The substantially crystalline polymer layer may be comprised of any non-elastic crystalline polymer that is capable of gaining elasticity by undergoing a heat treating process and is capable of being joined to an elastic layer to produce an anisotropic composite elastic.

Fifth Embodiment

An alternative embodiment of the fourth embodiment comprises modifying the method of producing the anisotropic composite elastic. A non-elastic, substantially crystalline polymer layer and an elastic layer are overlain lengthwise, with the polymer layer on top, and then heated to the transition temperature of the polymer layer. During cooling, the overlain layers are simultaneously stretched, so that the crystals of the polymer layer anneal into a modified structure capable of stretching and recovering, along with the elastic layer. Heating the two layers together, rather than heating only the polymer layer, serves the purpose of heat bonding the layers together, thereby eliminating the need to join the layers in a separate step. If bonding is not fully achieved, however, additional methods of joining the layers may be carried out, including the methods discussed with regard to the above embodiments.

As with the fourth embodiment, the substantially crystalline polymer layer may be comprised of any non-elastic crystalline polymer that is capable of gaining elasticity by undergoing a heat treating process and is capable of being joined to an elastic layer to produce an anisotropic composite elastic.

Sixth Embodiment

In yet another alternative embodiment of the fourth embodiment, an anisotropic composite elastic may be produced by heating a non-elastic, substantially crystalline polymer layer to its transition temperature and then, while simultaneously cooling and stretching the polymer layer, depositing extruded elastomeric fibers and filaments directly onto the polymer layer.

The fibers and filaments are deposited, with substantially uniform density, onto the stretched polymer layer such that the fibers are dispersed randomly among the elastomeric filaments and the filaments are arranged in rows that are substantially parallel to the direction in which the polymer layer is stretched. This method can be carried out by either depositing the extruded filaments first and then depositing the extruded fibers or by depositing the extruded fibers first and then depositing the extruded filaments. One method of forming a continuous sheet of the anisotropic elastic material comprises depositing the extruded filaments and fibers, using stationary equipment, onto a cooling polymer sheet that is both stretched and made mobile by tension wind-up techniques.

Due to the length and orientation of the filaments and the anisotropic elasticity imparted upon the polymer layer, the resulting composite elastic is able to stretch substantially only in the direction that is both parallel to the filaments and parallel to the direction in which the polymer layer was stretched during cooling. The extent to which the resulting composite is anisotropic, versus isotropic, may be adjusted by varying such parameters as the direction of the stretching force applied during the cooling process, the ratio of fiber lengths to filament lengths and the ratio of fiber concentration to filament concentration.

In addition, the maximum length achievable upon elongation of the resulting composite may be varied by adjusting such parameters as the tensioning force with which the polymer layer is stretched during deposition of the extruded fibers and filaments, the length of time the layer is held in the stretched configuration during deposition of the extruded fibers and filaments, and the rate of cooling during stretching, after reaching the transition temperature.

The elastomeric fibers and elastomeric filaments may be made from any material that may be manufactured into such fibers and filaments, including those materials discussed with regard to the first embodiment. The elastomeric filaments and the elastomeric fibers of the anisotropic elastic material may be manufactured by a variety of extrusion techniques, as well.

The elastomeric fibers, the elastomeric filaments and the polymer layer may bond wholly autogenously, partially autogenously, or non-autogenously. Where bonding occurs partially autogenously or non-autogenously, bonding may be improved or accomplished through the addition of tackifying resins to the filament-forming and/or fiber-forming compositions, prior to extrusion, or through the use of methods such as ultrasonic welding, powder bonding, pattern embossing, solvent bonding, hydraulic entangling, and needle punching.

Furthermore, in addition to heat that may be applied during certain extrusion processes, heat, as well as pressure, may be applied to the resulting composite to improve or accomplish bonding after deposition of the fibers and filaments onto the polymer layer. However, if additional modifications of the crystal structure are undesirable, the composite must first be cooled to a temperature at which the crystals are no longer capable of annealing, prior to the start of the heat bonding process. Moreover, the temperature to which the composite is raised during the heat bonding process must remain below the transition temperature of the polymer.

As with the fourth embodiment, the substantially crystalline polymer layer may be comprised of any non-elastic crystalline polymer that is capable of gaining elasticity by undergoing a heat treating process and is capable of being joined to an elastic layer to produce an anisotropic composite elastic.

Seventh Embodiment

In a seventh embodiment of the invention, the anisotropic composite elastic is comprised of at least two anisotropic elastic layers. The layers may comprise the same or different types of anisotropic elastics. If the percent elongation and recovery differs between the two layers, the maximum length achievable, upon elongation of the resulting anisotropic composite elastic, will be limited by the layer that is capable of stretching the least.

Any methods of joining the layers and any materials comprising the layers may be utilized, as long as the resulting composite is anisotropic. Appropriate materials comprising the layers and appropriate methods of joining the layers include those discussed with regard to all of the above embodiments.

Exemplary Anisotropic Elastic Materials

Examples of processes that may be utilized to produce anisotropic elastic materials, as described in the above embodiments, are disclosed, for example, in U.S. Pat. Nos. 4,720,415, 5,226,992 and 5,316,837, whose teachings are herein incorporated by reference, and U.S. Pat. No. 5,385,775, to which reference was previously made.

Cover Material

The mask includes a cover material, which may be secured to a wearer's face by any of the anisotropic elastics or anisotropic composite elastics discussed in the above embodiments. The features of the cover material may vary, depending upon its designed purpose. For example, the materials comprising an eye mask for filtering light will have much different characteristics than the materials comprising a surgical mask utilized for filtering contaminants. Regardless of its design and intended purpose, however, a substantially superior mask may be produced by utilizing the disclosed anisotropic elastics and anisotropic composite elastics, the use of which satisfies the need for a comfortable, hypoallergenic mask that may be securely fastened and that may be inexpensively produced.

First Embodiment

Figure 3:
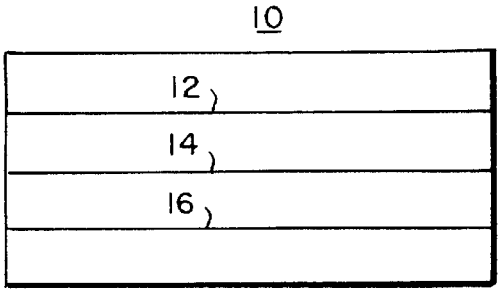
FIG. 3 illustrates a cross-sectional view of a first embodiment of the cover material portion of the mask.

FIG. 3 illustrates a cross-sectional view of a first embodiment of the cover material portion of the mask. The cover material 10 comprises a substantially rectangular material which may be secured over a wearer's nose and mouth by an anisotropic elastic or an anisotropic composite elastic (not shown). The cover material 10 has pleats 12, 14, and 16 formed therein, which allow the cover material 10 to expand over the wearer's nose and mouth, as illustrated in the perspective view of FIG. 4.

The cover material may be made from any material and by any method that renders it effective for its designed purpose. For example, the cover material may comprise cotton, rayon, linen, paper, one or more polymeric materials, such as polypropylene, polyurethane or polyethylene, one or more other fibrous materials, or a combination of any of these. The cover material may be a woven or a nonwoven fabric, including gauze, mesh, foam, film, or a combination of any of these. The cover material may comprise at least two layers of the same or different materials, wherein the layers are joined together in at least two locations.

The method of making the cover material may include, for example, meltblowing, spunbonding, or other extrusion techniques, followed by wholly or partially autogenous bonding or non-autogenous bonding of the various fabrics and fibers comprising the cover material. Non-autogenous or partially autogenous bonding may be accomplished, for example, by applying heat or pressure to the desired bonding sites. Bonding may also be accomplished by adding one or more binders, tackifying resins or adhesives to the materials comprising the cover material. A suitable thermoplastic binder, for example, is an emulsion polymerized self-curing acrylic binder.

Second Embodiment

Figure 5:
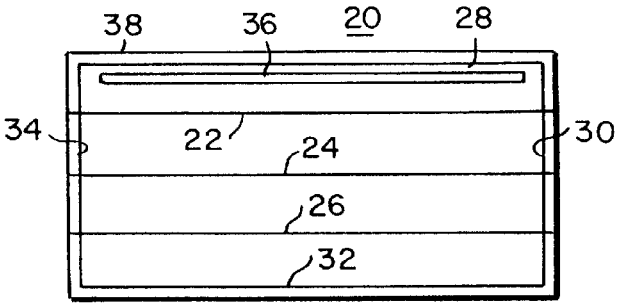
FIG. 5 illustrates a cross-sectional view of a second embodiment of the cover material portion of the mask.

FIG. 5 illustrates a cross-sectional view of a second embodiment of the cover material portion of the mask. The cover material 20 comprises a substantially rectangular material, which may be secured over a wearer's nose and mouth by an anisotropic elastic or an anisotropic composite elastic (not shown). The cover material is similar to the cover material of the first embodiment, but further comprises additional features to increase the durability and filtration effectiveness of the mask.

The cover material has pleats 22, 24, and 26 formed therein, which allow the cover material to expand over the wearer's nose and mouth. Reinforcing seams 28, 30, 32 and 34 are located around the edges of the cover material, to prevent fraying around the edges of the cover material and, if the cover material is multi-layered, to prevent splitting between the layers. The cover material includes a semi-rigid member 36, located adjacent to the top edge 38 of the cover material. The semi-rigid member 36 may be bent over the bridge of the wearer's nose and molded against the wearer's facial features, thereby forming a seal for preventing contaminants from entering and exiting the mask.

In addition, the cover material may include particles or layers forming molecular sieves, absorbents, or adsorbents disposed on either the inside or the outside of the cover material, wherein the particles or layers have an affinity for a particular compound, so as to further prevent the particular compound from entering or exiting the mask. For example, in order to prevent a wearer's exposure to nitrous oxide, an anesthetic, a mask may contain an outer layer of silicalite or certain zeolite particles that have an affinity for nitrous oxide.

The cover material may be made from any material and by any process that renders it effective for a designed purpose, such as to provide a pre-specified degree of filtration effectiveness. For example, appropriate materials and processes may include those specified in the first embodiment of the cover material. The reinforcing seams 28, 30, 32 and 34 may be formed by numerous methods, including, for example, ultrasonic welding, powder bonding, pattern embossing, solvent bonding, thermal bonding, needle punching, stitching, or gluing. The semi-rigid member 36 may be attached to the cover material by numerous methods, as well, including, for example, by gluing or by inserting the semi-rigid member 36 between two layers comprising the cover material, wherein the layers are joined together around the semi-rigid member 36, such that the semi-rigid member 36 is held firmly in place.

Third Embodiment

Figure 6:
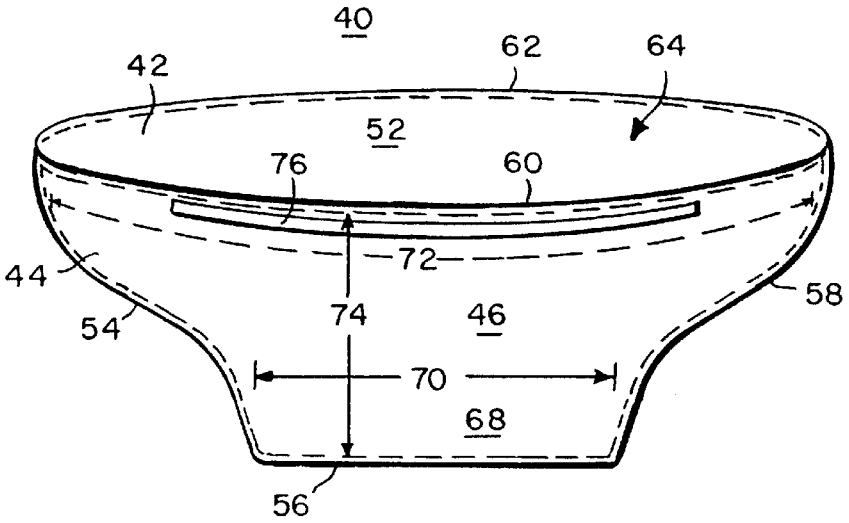
FIG. 6 illustrates a perspective view of a third embodiment of the cover material portion of the mask.

FIG. 6 illustrates a perspective view of a third embodiment of the cover material portion of the mask. The cover material 40 is comprised of top and bottom portions 42 and 44. The top portion 42 has a front side 46 and a back side 48 (not shown) and the bottom portion 44 has front and back sides 50 and 52. The top and bottom portions 42 and 44 are joined along three contiguous edges 54, 56 and 58. The top and bottom portions 42 and 44 each have non-contiguous edges 60 and 62, respectively, located opposite to each other. The non-contiguous edges 60 and 62 define an opening 64 which may be cupped over the mouth and nostrils of a wearer, so that the back sides 48 and 52 form an inner surface directed toward the wearer's face, the front sides 46 and 50 form an outer surface and the contiguous edges 54, 56 and 58 form a junction that is disposed substantially across the center of the cover material 40. As illustrated in the perspective view of FIG. 7, the cover material 40 may be secured over a wearer's face by an anisotropic elastic band 66 connected on opposite sides of the inner surface of the cover material 40, such that the anisotropic elastic band 66 encircles the wearer's head.

Figure 7:
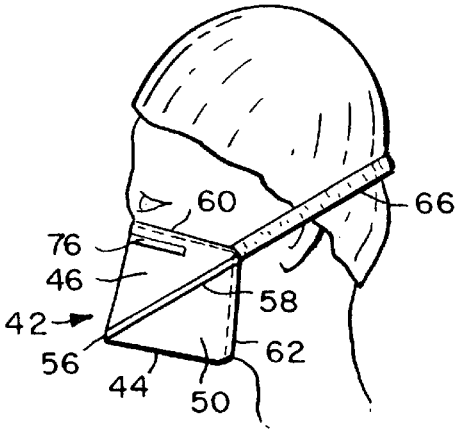
FIG. 7 illustrates a perspective view of the cover material of FIG. 6, in which the cover material is secured to a wearer's face.

The edges 54 and 58 of the cover material 40 curve inward adjacent to the edge 56, to form an outward-projecting portion 68 having a width 70 that is narrower than the width 72 adjacent to the non-contiguous edges 60 and 62. With the non-contiguous edges 60 and 62 pulled snugly against a wearer's face, as illustrated in FIG. 7, the outward-projecting portion 68 extends away from the wearer's face, thereby giving the wearer extra breathing room. The amount of breathing room may be varied to accommodate different personal preferences and sizes of faces by varying such parameters as the curvature of the edges 54 and 58, the width 70 of the outward-projecting portion 68 and the perpendicular width 74 extending from the edge 56 to the non-contiguous edges 60 and 62.

The cover material 40 includes a semi-rigid member 76, disposed adjacent to the non-contiguous edge 60. The semi-rigid member 76 may be bent over the bridge of the wearer's nose and molded against the wearer's facial features, thereby forming a seal for preventing contaminants from entering and exiting the mask. The cover material 40 may include additional features, as well, such as reinforcing seams and/or particles or layers forming molecular sieves, absorbents, or adsorbents, as described with regard to the second embodiment. The cover material 40 may be manufactured from any of a variety of materials, using numerous methods, including, for example, the materials and/or methods described with regard to the first and second embodiments.

Methods of Securing the Mask

First Embodiment

Figure 4:
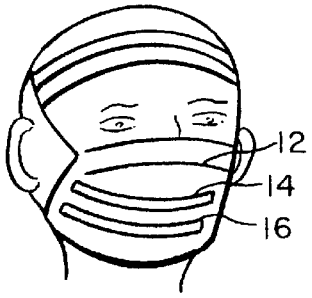
FIG. 4 illustrates a perspective view of the cover material of FIG. 3, in which the cover material is secured to a wearer's face.
Figure 8:
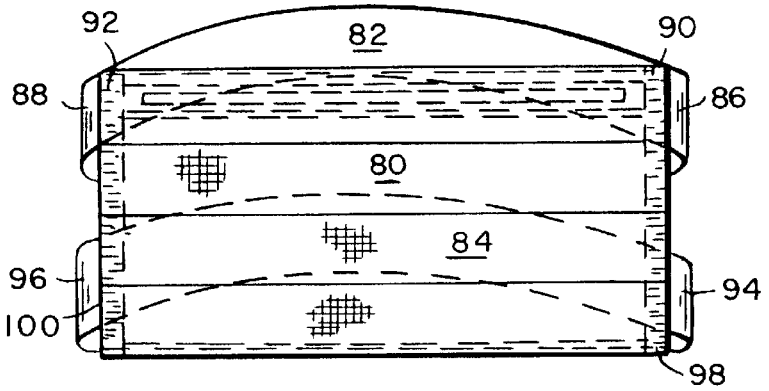
FIG. 8 illustrates a perspective view of a first embodiment of the mask.

FIG. 8 illustrates a first embodiment of the mask, in which the back side of a substantially rectangular cover material 80 is shown in planar view and first and second anisotropic elastic bands 82 and 84 for securing the cover material over a wearer's mouth and nostrils are shown in perspective view. The first band 82 has right and left ends 86 and 88 that attach to the upper right and upper left sides 90 and 92 of the cover material 80, so as to encircle the wearer's head, thereby securing the cover material 80 to the wearer's face. The second band 84 has right and left ends 94 and 96 that attach to the lower right and lower left sides 98 and 100 of the cover material 80, so as to encircle the wearer's head in an arrangement substantially parallel to the first band 82, thereby further securing the cover material 80 to the wearer's face. FIG. 4 illustrates a perspective view of a mask, disposed on a wearer by first and second bands, as described in this embodiment.

Second Embodiment

Figure 9:
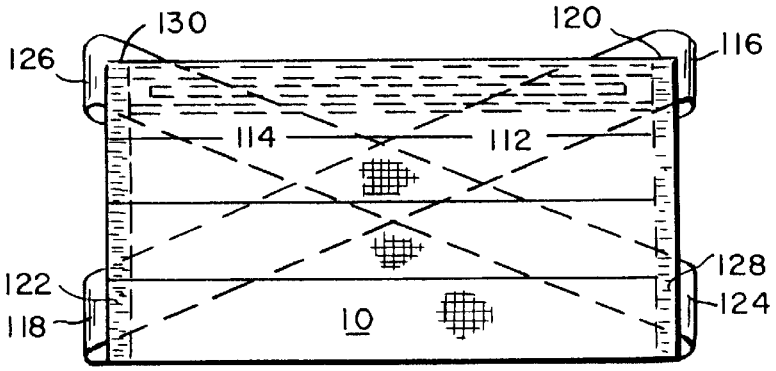
FIG. 9 illustrates a perspective view of a second embodiment of the mask.

FIG. 9 illustrates a second embodiment of the mask, in which the back side of a substantially rectangular cover material 110 is shown in planar view and first and second anisotropic elastic bands 112 and 114 for securing the cover material over a wearer's mouth and nostrils are shown in perspective view. The first band 112 has right and left ends 116 and 118 that attach to the upper right and lower left sides 120 and 122 of the cover material 110, so as to encircle the wearer's head, thereby securing the cover material 110 to the wearer's face. The second band 114 has right and left ends 124 and 126 that attach to the lower right and upper left sides 128 and 130 of the cover material 110, so as to encircle the wearer's head in an arrangement that forms a criss-cross with the first band 112, thereby further securing the cover material 110 to the wearer's face.

Third Embodiment

Figure 10:
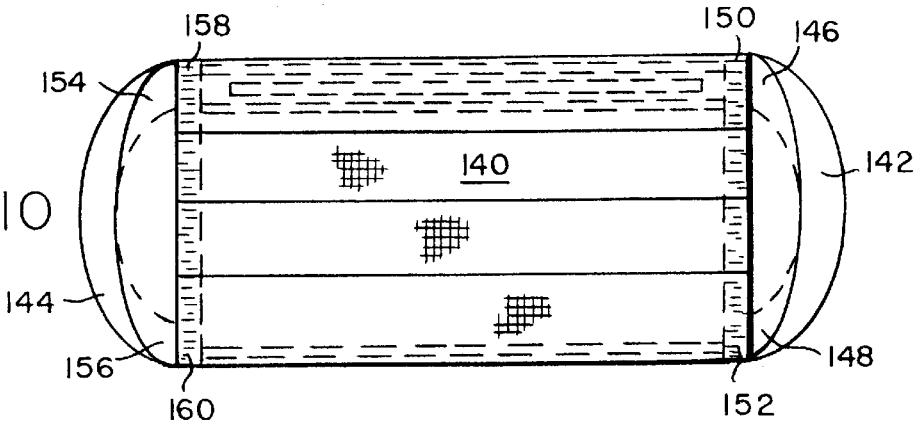
FIG. 10 illustrates a perspective view of a third embodiment of the mask.

FIG. 10 illustrates a third embodiment of the mask, in which the back side of a substantially rectangular cover material 140 is shown in planar view and right and left anisotropic loops 142 and 144 for securing the cover material over a wearer's mouth and nostrils are shown in perspective view. The right loop 142 has top and bottom ends 146 and 148 that attach to the upper and lower right sides 150 and 152 of the cover material 140. The left loop 144 has top and bottom ends 154 and 156 that attach to the upper and lower left sides 158 and 160 of the cover material 140. The cover material is firmly secured to the wearer's face by looping the right and left loops 142 and 144 around the back of the wearer's right and left ears, respectively.

Fourth Embodiment

Figure 11:
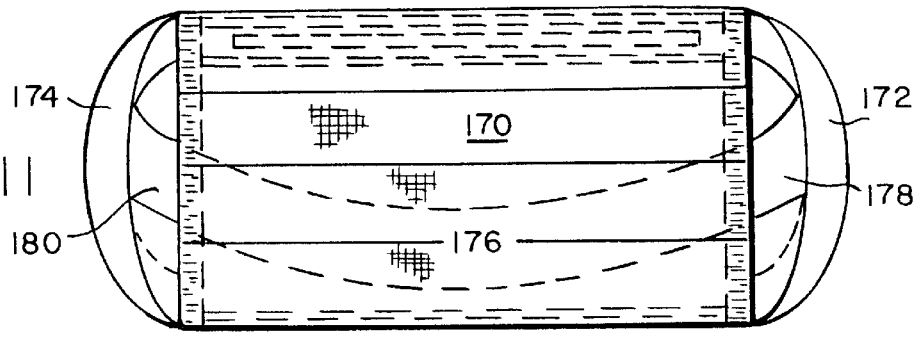
FIG. 11 illustrates a perspective view of a fourth embodiment of the mask.

FIG. 11 illustrates a fourth embodiment of the mask, in which the back side of a substantially rectangular cover material 170 is shown in planar view and anisotropic straps for securing the cover material over a wearer's mouth and nostrils are shown in perspective view. The anisotropic straps are comprised of right and left loops 172 and 174 that attach to the cover material 170 in the manner described with regard to the third embodiment. In addition, the mask further comprises a center anisotropic band 176, having right and left ends 178 and 180 that attach to the right and left loops, 172 and 174, respectively. When worn, the right and left loops 172 and 174 loop around the back of the wearer's right and left ears, respectively, and the center band 176 partially encircles the wearer's head. In addition to further securing the cover material 170 to the wearer's face, the center band 176 pulls the loops 172 and 174 slightly away from the back of the wearer's ears, toward the back of the wearer's head, thereby preventing the loops 172 and 174 from rubbing the skin surrounding the back of the wearer's ears.

Fifth Embodiment

Figure 12:
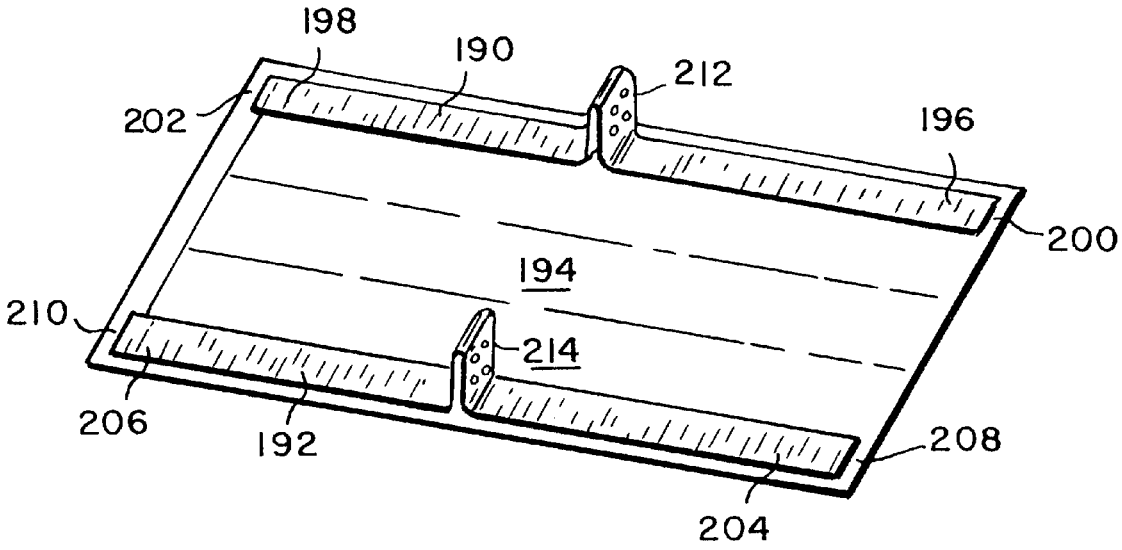
FIG. 12 illustrates a fifth embodiment of the mask, in which first and second anisotropic elastic bands are shown in perspective view and the back side of a cover material is shown in planar view.

FIG. 12 illustrates a fifth embodiment of the mask, in which first and second anisotropic elastic bands 190 and 192 are shown in perspective view lying against the back side of a substantially rectangular cover material 194, shown in planar view. The first band 190 has right and left ends 196 and 198 that attach to the upper right and upper left sides 200 and 202 of the cover material 194. The second band 192 has right and left ends 204 and 206 that attach to the lower right and lower left sides 208 and 210 of the cover material 194, in an arrangement substantially parallel to the first band 190. When worn, the first and second bands 190 and 192 encircle a wearer's head, thereby securing the cover material 194 over the wearer's face, as described with regard to the first embodiment. In this embodiment of the mask, however, the first and second bands 190 and 192 further comprise extension flaps 212 and 214, respectively, formed therein for extending the lengths of the bands 190 and 192 to accommodate different head sizes and tensioning preferences.

Figure 13:
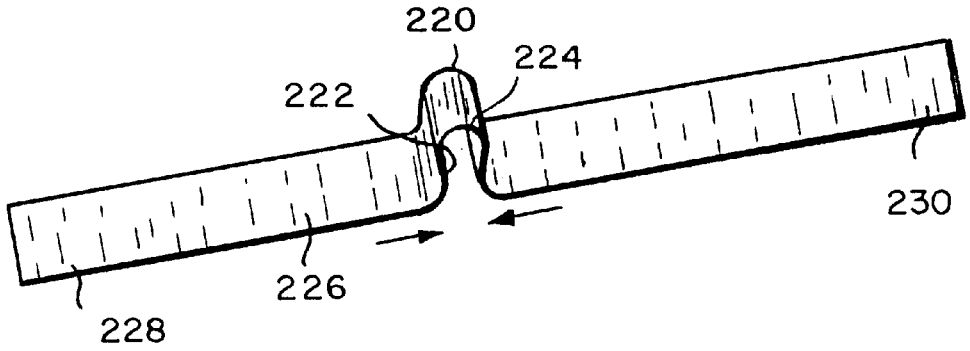
FIG. 13 illustrates a perspective view of a method for making the first and second anisotropic elastic bands of FIG. 12.
Figure 14:
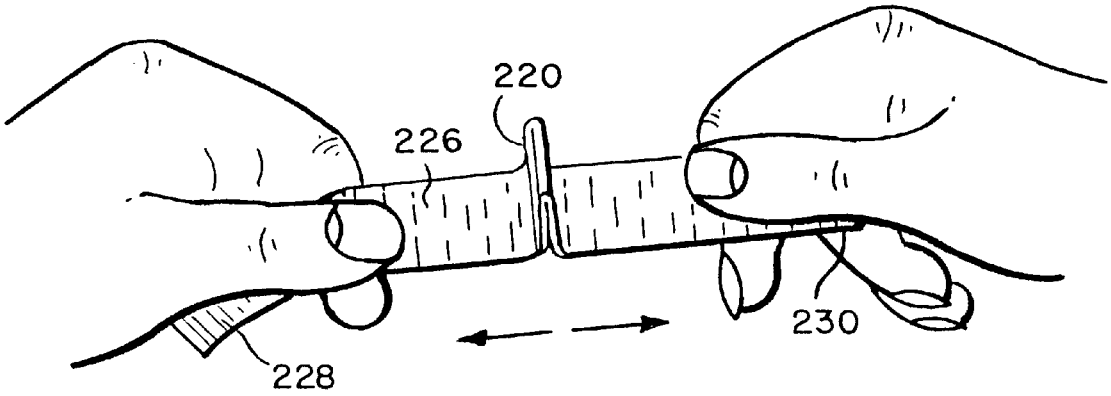
FIG. 14 illustrates a perspective view of a method for extending the length of the first and second anisotropic elastic bands of FIG. 12.

An extension flap 220, such as the extension flaps 212 and 214, may be constructed by folding together and frangibly connecting two portions 222 and 224 of an inner surface of a band 226, as illustrated in the perspective view of FIG. 13. As illustrated in the perspective view of FIG. 14, the length of the band 226 may be increased by pulling the ends 228 and 230 of the band 226 in opposite directions, so as to peel a portion or all of the flap 220 apart, thereby extending the length of the band 226. The flap 220 is designed so that the strength of the frangible connection is substantially greater than the ordinary force with which the band 226 is stretched as the mask is donned and secured snugly to a wearer's face for long periods of wear. The strength of the frangible connection, however, is not so great that one must exert an undue amount of force in order to extend the band 226 to the desired length.

Figure 15A:
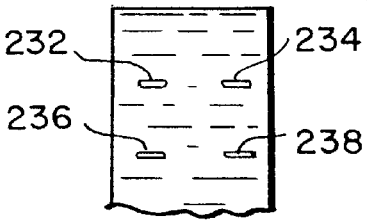
FIG. 15*a* illustrates a cross-sectional, exploded view of the extension flap of FIG. 14.
Figure 15B:
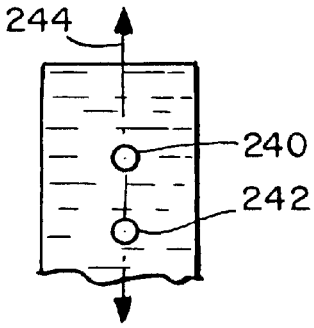
FIG. 15*b* illustrates a first alternative embodiment of the extension flap of FIG. 14.
Figure 15C:
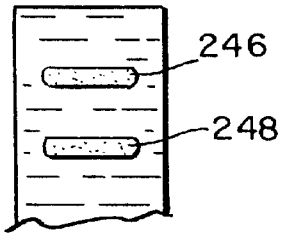
FIG. 15*c* illustrates a second alternative embodiment of the extension flap of FIG. 14.
Figure 15D:
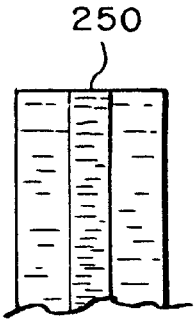
FIG. 15*d* illustrates a third alternative embodiment of the extension flap of FIG. 14.

The frangible connection may be formed by joining the two portions 222 and 224 of the inner surface of the band 226 at any number of points ranging from one point to an array of substantially infinite points, such that, in the latter case, the two portions 222 and 224 are joined over their entire inner surfaces areas. FIG. 15*a* is an exploded view of the flap 220 of FIG. 14, in which the two portions 222 and 224 are joined together along an array of four lines 232, 234, 236 and 238 resembling a 2×2 matrix. FIGS. 15*b*, 15*c* and 15*d* are exploded views of alternative arrays with which the two portions 222 and 224 may be joined. The array of FIG. 15*b* resembles two dots 242 and 244, through which an axis 246 may be drawn that is parallel to the direction in which the band 226 may be pulled in order to extend its length. The array of FIG. 15*c* resembles two parallel lines 248 and 250, that are oriented perpendicular to the direction in which the band 226 may be pulled in order to extend its length. The array of FIG. 15*d* comprises a line 252 of connecting points oriented parallel to the direction in which the band 226 may be pulled in order to extend its length.

The type of array selected to join the two portions 222 and 224 of the band 226 may be varied, depending upon the desired characteristics of the frangible connection. For example, the use of the array of connections illustrated in FIG. 15*a* or FIG. 15*c* enables a band to extend twice—once for each row of connections broken—so that the mask in which the band is incorporated may be adjusted from the original size to two larger sizes. Likewise, the use of the array illustrated in FIG. 15*b* enables a band to extend twice—one for each connecting dot 242 and 244 that may be frangibly disconnected. As the number of connecting points or rows extending perpendicular to the band length increases, the resolution between each of the connecting points decreases, such that the number of possible band lengths approaches a continuum, as illustrated by the array of FIG. 15*d*, in which the connecting points merge to form a continuous line 252 oriented parallel to the direction in which the band 226 may be pulled.

The frangible connection may be formed by any methods that achieve the desired strength of the frangible connection and the desired number and array of points with which the two portions of the band are connected. Examples of methods for forming the frangible connection include, for example, ultrasonic welding, powder bonding, pattern embossing, thermal pin embossing, solvent bonding, gluing, needle punching, and the use of adhesives.

Methods of Attaching the Anisotropic Elastic to the Cover Material

The anisotropic elastic material and the anisotropic composite elastic material may be cut into widths and lengths appropriate for securing the cover material to a wearer's face with a firm, yet comfortable tensioning force. Thereafter, the anisotropic elastic material may be attached to the cover material by numerous methods. These methods include the use of adhesive, stitching, stapling, thermal bonding, pattern embossing, solvent bonding, ultrasonic welding, and incorporating an intermediate fastener between the anisotropic elastic material and the mask, such as separable fasteners of the hook and loop type commonly described using the VELCRO trademark (hereinafter "hook and loop type fastener"), snaps or buttons. Moreover, by employing an intermediate fastener having more than one location onto which an anisotropic elastic may be connected, the mask of the present invention can be adjusted to accommodate different head sizes and tensioning preferences.

Figure 16A:
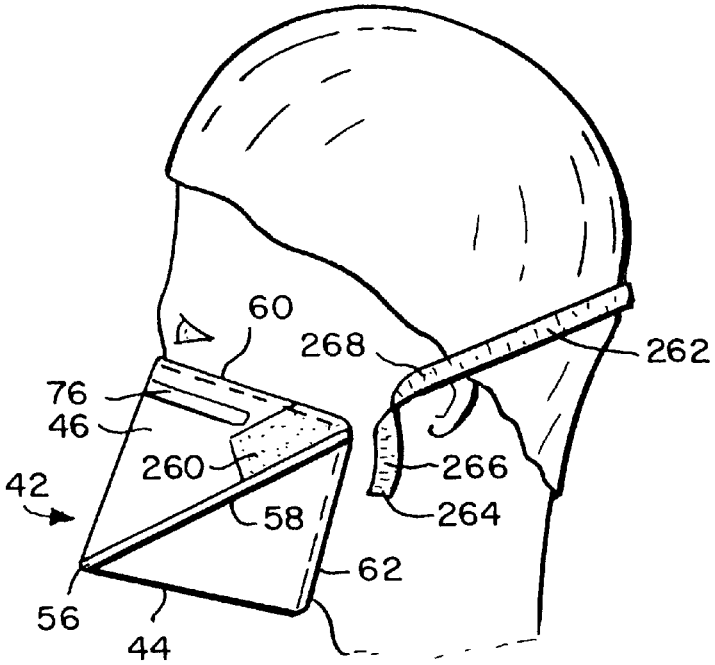
FIG. 16*a* illustrates a perspective side view of an embodiment of the mask that incorporates the cover material of FIG. 6.
Figure 16B:
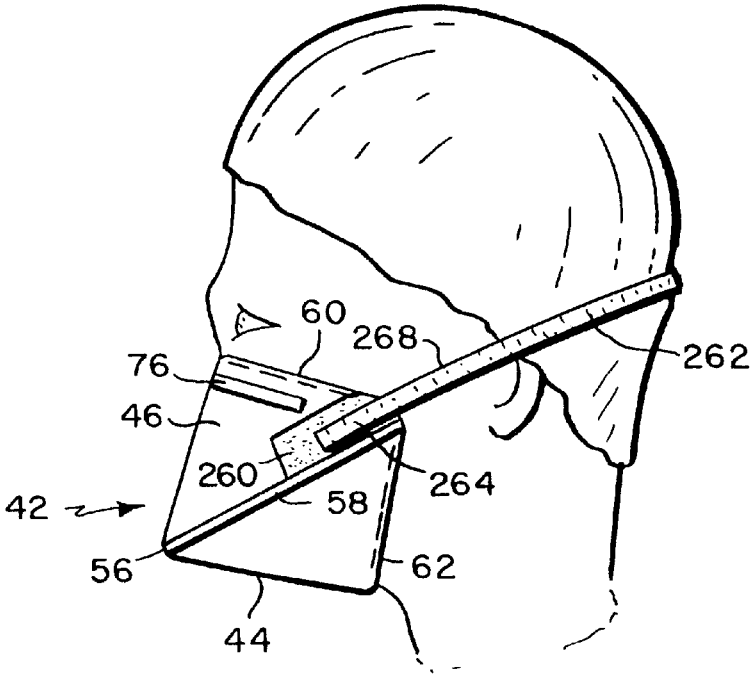
FIG. 16*b* illustrates a perspective side view of the mask of FIG. 16*a*.

For example, FIG. 16*a* illustrates, in a perspective side view, an embodiment of the mask in which the cover material 40 of FIG. 6 further comprises a strip of separable fasteners of the hook and loop type commonly described using the VELCRO trademark (hereinafter "hook and loop strip") 260 attached to the front side 46 of the top portion 42 of the cover material 40. The mask includes a single anisotropic elastic band 262 having a left end 264 and a right end (not shown). The left end 264 of the anisotropic elastic band 262 has inner and outer surfaces 266 and 268. The cover material 40 may be secured to the wearer's face by adhering the inner surface 266 of the left end 264 of the anisotropic elastic band 262 to the hook and loop strip 260, as illustrated in perspective view in FIG. 16*b*.

The mask may be designed so that the right end of the anisotropic elastic band 262 connects to the right side of the cover material 40 by an intermediate fastener such as a hook and loop type fastener as well. Alternatively, the right end of the anisotropic elastic band 262 may be permanently attached to the right side of the cover material.

A hook and loop type fastener is particularly suitable as an intermediate fastener because anisotropic elastics tend to adhere strongly to it. This eliminates the necessity to attach an extra piece of fuzzy material onto the anisotropic elastic in order to form a solid connection. Furthermore, the use of a hook and loop type fastener enables the tension of the band 262 and therefore the size of the mask to be adjusted within a large, continuous range, wherein the magnitude of the range depends on the length of the hook and loop strip and the size of the wearer's head.

Although several methods of attaching the anisotropic elastic to the cover material have been described, one skilled in the art will appreciate that numerous additional means of attachment may be utilized, without departing from the spirit and scope of the invention.

Other Embodiments

The foregoing has provided a description of certain preferred embodiments of the present invention, which description is not meant to be limiting. Other embodiments of the present invention are within the scope of the following claims.

What is claimed is:

1. A face mask comprising:

a cover material dimensioned to cover a portion of a face of a wearer, said cover material having:

a top side and a bottom side; and a left side and a right side, said left side and said right side each having an upper portion and a lower portion; and an anisotropic elastic material attached to said cover material, so that said cover material may be secured by said elastic material to cover said portion of a wearer's face.

2. A face mask comprising:

a cover material dimensioned to cover a portion of a face of a wearer, said cover material having:

a top side and a bottom side; and a left side and a right side, said left side and said right side each having an upper portion and a lower portion; and an anisotropic composite elastic material attached to said cover material, so that said cover material may be secured by said composite elastic material to cover said portion of a wearer's face, said anisotropic composite elastic material having:

a first layer comprising an isotropic elastic material; and a second layer joined to said first layer, said second layer comprising a non-elastic layer having a fixed length.

3. A face mask comprising:

a cover material dimensioned to cover a portion of a face of a wearer, said cover material having:

a top side and a bottom side; and a left side and a right side, said left side and said right side each having an upper portion and a lower portion; and an anisotropic composite elastic material attached to said cover material, so that said cover material may be secured by said composite elastic material to cover said portion of a wearer's face, said anisotropic composite elastic material having:

a first layer comprising an anisotropic elastic material; and a second layer joined to said first layer.

4. A face mask comprising:

a cover material dimensioned to cover a portion of a face of a wearer, said cover material having:

a top side and a bottom side; and a left side and a right side, said left side and said right side each having an upper portion and a lower portion; and an anisotropic composite elastic material attached to said cover material, so that said cover material may be secured by said composite elastic material to cover said portion of a wearer's face, said anisotropic composite elastic material having:

a first layer comprising an elastic material; and a second layer joined to said first layer, said second layer comprising a substantially crystalline non-elastic polymer.

5. The mask of claim 1, in which said anisotropic elastic material comprises:

a plurality of substantially parallel elastomeric filaments; and a plurality of elastomeric fibers bonded to said filaments, said anisotropic elastic being elongatable in a direction parallel to said filaments.

6. The mask of claim 1, in which said anisotropic elastic material comprises:

a plurality of substantially parallel elastomeric filaments; and a plurality of elastomeric fibers entangled with said filaments, said anisotropic elastic being elongatable in a direction parallel to said filaments.

7. The mask of claim 2 or 3, in which said first layer comprises a material selected from the group consisting of a nonwoven web, a woven web, a knitted web and a film.

8. The mask of claim 5 or 6, in which said elastomeric filaments and said elastomeric fibers are selected from the group consisting of polyesters, polyurethanes, polyamides, copolymers of ethylene and at least one vinyl monomer, copolymers of butadiene and styrene, and A—B—A' block copolymers in which A and A' are the same or different polymer blocks, and in which B is an elastomeric polymer block.

9. The mask of claim 2, in which said first layer comprises an elastic formed by extrusion processes.

10. The mask of claim 3, in which said first layer comprises an elastic formed by extrusion processes.

11. The mask of claim 9 or 10, in which said extrusion processes are selected from the group consisting of melt-blowing processes, spunbonding processes and film extrusion processes.

12. The mask of claim 2 or 3, in which said second layer comprises a material selected from the group consisting of a nonwoven fabric and a woven fabric.

13. The mask of claim 2 or 3, in which said second layer comprises a material selected from the group consisting of a creped flexible sheet and a corrugated flexible sheet.

14. The mask of claim 2, in which spaced-apart locations of said second layer are joined to said first layer, so that said anisotropic composite elastic material may be stretched in one direction between:

a relaxed length in which said second layer forms puckers between said spaced-apart locations in a direction perpendicular to said direction of stretching, so that said relaxed length of said anisotropic composite elastic material is less than said fixed length of said second layer; and an elongated length in which said anisotropic composite elastic material is equal to or less than said fixed length of said second layer.

15. The mask of claim 3 or 4, in which spaced-apart locations of said second layer are joined to said first layer, so that said anisotropic composite elastic material may be stretched in one direction between:

an elongated length; and a relaxed length in which said second layer forms puckers between said spaced-apart locations in a direction perpendicular to said direction of stretching.

16. The mask of claim 2 or 3, in which said first layer and said second layer are joined by processes selected from the group consisting of ultrasonic welding, thermal bonding, pressure bonding, powder bonding, pattern embossing, gluing and needle punching.

17. The mask of claim 1, in which said anisotropic elastic material comprises at least one anisotropic elastic band having:

a left end attached to said left side of said cover material; and a right end attached to said right side of said cover material, so that said mask encircles a head of a wearer, thereby securing said cover material to a wearer's face.

18. The mask of claim 17, in which said anisotropic elastic band attaches to said right side of said cover material by an adjustment device for accommodating different head sizes and tensioning preferences of said anisotropic elastic band.

19. The mask of claim 17, in which said adjustment device comprises:

at least one hook and loop strip attached to said right side of said cover material; and at least one fuzzy strip attached to said right end of said anisotropic elastic band, said at least one fuzzy strip being capable of firmly sticking to said hook and loop strip at any location along the lengths of said hook and loop strip and said fuzzy strip, so as to encircle the head of said wearer, thereby securing said cover material to a wearer's face.

20. The mask of claim 17, in which said at least one anisotropic elastic band further comprises an adjustable extension located between said left end and said right end of said anisotropic elastic band, said adjustable extension being formed from at least one frangible connection between two portions of an inner side of said anisotropic elastic band, so that a wearer may lengthen said anisotropic elastic band by pulling said left end and said right end in opposite directions, away from said adjustable extension.

21. The mask of claim 20, in which said at least one frangible connection is formed from processes selected from the group consisting of ultrasonic welding, powder bonding, pattern embossing, thermal pin embossing, solvent bonding, gluing, needle punching, and the use of adhesives.

22. The mask of claim 17, in which said at least one anisotropic elastic band comprises a first band and a second band, said second band being attached to said cover material substantially parallel to said first band.

23. The mask of claim 17, in which said at least one anisotropic elastic band comprises a first band and a second band, said first band and said second band being attached to said cover material so that said first band and said second band criss-cross each other.

24. The mask of claim 1, in which said anisotropic elastic material comprises:

a left anisotropic elastic band having an upper end and a lower end, said upper end of said left band being attached to said upper portion of said left side of said cover material and said lower end being attached to said lower portion of said left side of said cover material; and a right anisotropic elastic band having an upper end and a lower end, said upper end of said right band being attached to said upper portion of said right side of said cover material and said lower end being attached to said lower portion of said right side of said cover material, said right band and said left band being attached to said cover material so that said cover material may be secured to a wearer's face.

25. The mask of claim 24, in which said cover material may be secured to a wearer's face by looping said right band around a right ear of said wearer and looping said left band around a left ear of said wearer.

26. The mask of claim 24, further comprising a center anisotropic elastic band, said center band having a right end and a left end, said right end of said center band being attached proximally to a middle point of said right band and said left end of said center band being attached proximally to a middle point of said left band, so that said cover material may be secured to a wearer's face.

27. The mask of claim 1, in which said cover material is comprised of substances selected from the group consisting of cotton, rayon, linen, paper, fibrous materials, and polymeric materials.

28. The mask of claim 1, in which a layer of particles having an affinity for a particular compound is disposed on said cover material, so that said layer of particles prevents said particular compound from passing through said cover material.

29. The mask of claim 28, in which said particular compound is selected from the group consisting of adsorbents and absorbents.

30. The mask of claim 1, in which said cover material further comprises at least one pleat formed therein for expanding said cover material when worn.

31. The mask of claim 1, in which said cover material further comprises a semi-rigid member located along said top side of said cover material, said semi-rigid member being moldable against a wearer's face, so that said cover material may be conformed to a wearer's face.

32. The mask of claim 1, in which said cover material further comprises reinforcing seams around a perimeter of said cover material.

33. The mask of claim 1, in which said anisotropic elastic material and said cover material are attached by processes selected from the group consisting of ultrasonic welding, thermal bonding, pressure bonding, powder bonding, pattern embossing, gluing, stitching, stapling and needle punching.

34. The mask of claim 1, further comprising an attachment device for attaching said anisotropic elastic material to said cover material, said device being located between said anisotropic elastic material and said cover material.

35. The mask of claim 34, in which said attachment device is selected from the group consisting of stitches, staples, adhesives, hook and loop type fasteners, snaps and buttons.

* * * * *